US006447240B1

(12) United States Patent
Cain et al.

(10) Patent No.: US 6,447,240 B1
(45) **Date of Patent: *Sep. 10, 2002**

(54) ARRANGEMENT FOR DETERMINING THE RELATIVE ANGULAR ORIENTATION BETWEEN A FIRST MACHINE ELEMENT AND A SECOND MACHINE ELEMENT

(75) Inventors: Gary L. Cain, Springfield; Richard Piekutowski, Huber Heights, both of OH (US)

(73) Assignee: Trimble Navigation Limited, Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/521,011

(22) Filed: Mar. 8, 2000

Related U.S. Application Data

(63) Continuation-in-part of application No. 09/465,043, filed on Dec. 16, 1999, now Pat. No. 6,325,590, which is a continuation-in-part of application No. 08/984,861, filed on Dec. 4, 1997, now Pat. No. 6,099,235.

(51) Int. Cl.[7] ..... E02F 3/43
(52) U.S. Cl. ..... 414/694; 33/710; 92/5 R
(58) Field of Search ..... 414/694, 697, 414/698, 699; 33/710, 809, 810, 1 PT; 92/5 R; 242/615.3

(56) References Cited

U.S. PATENT DOCUMENTS

| | | | |
|---|---|---|---|
| 3,017,046 | A | 1/1962 | Runci et al. |
| 3,141,563 | A | 7/1964 | Fisher |
| 4,020,963 | A | 5/1977 | Carter |
| 4,182,599 | A | 1/1980 | Eyrick et al. |
| 4,793,241 | A | 12/1988 | Mano et al. |
| 4,879,440 | A | 11/1989 | Lymburner |
| 4,898,079 | A | 2/1990 | Combette |
| 4,964,779 | A | 10/1990 | Sagaser |
| 4,987,822 | A | 1/1991 | Stoll |
| 5,062,264 | A | 11/1991 | Frenette et al. |
| 5,231,352 | A | 7/1993 | Huber |
| 5,461,803 | A | 10/1995 | Rocke |

FOREIGN PATENT DOCUMENTS

FR 2665199 1/1992

OTHER PUBLICATIONS

OakGrigsby Brochure, 900 Series Optical Encoders, 1996.
UniMeasure Brochure, Position and Velocity Transducers.
UniMeasure Brochure, HX–EP Series Position Transducer.
SpageAge Control, Inc. "Application Note".
Cable Manufacturing & Assembly Co., Inc. Product Information.

*Primary Examiner*—Donald W. Underwood
(74) *Attorney, Agent, or Firm*—Killworth, Gottman, Hagan & Schaeff LLP

(57) ABSTRACT

An arrangement is provided for determining the relative angular orientation between an excavator bucket and the dipper stick of an excavator. The excavator bucket is mounted on a bucket linkage that is pivotally secured to the end of the dipper stick. An hydraulic actuator has an hydraulic cylinder pivotally connected to the dipper stick, and a piston rod pivotally connected to the bucket linkage. Extension or contraction of the hydraulic actuator causes the excavator bucket to be pivoted by the bucket linkage with respect to the dipper stick. A cable extension linear position transducer having a transducer casing, a sheath extending from the casing to a pulley system, and an extensible belt cable extending from the sheath through the pulley system to an end of the piston rod, provides an electrical output related to the extension of the belt cable from the sheath. A transducer mounting secures the casing of the cable extension linear position transducer in fixed relationship to the hydraulic cylinder. A clip or a release mechanism secures the extensible belt cable to the piston rod. By this arrangement, extension or contraction of the hydraulic actuator causes the output of the transducer to vary, thus providing an electrical output related to the relative angular orientation of the excavator bucket with respect to the dipper stick.

9 Claims, 14 Drawing Sheets

ARRANGEMENT FOR DETERMINING THE RELATIVE ANGULAR ORIENTATION BETWEEN A FIRST MACHINE ELEMENT AND A SECOND MACHINE ELEMENT

CROSS-REFERENCE TO RELATED APPLICATIONS

This application is a Continuation-in-Part of U.S. patent application Ser. No. 09/465,043 filed Dec. 16, 1999, now U.S. Pat. No. 6,325,590, which is a Continuation-in-Part of U.S. patent application Ser. No. 08/984,861 filed Dec. 4, 1997 now U.S. Pat. No. 6,099,235.

BACKGROUND OF THE INVENTION

The present invention relates to an arrangement for determining the relative angular orientation between a first machine element and a second machine element and, more particularly, to an arrangement for determining the relative angular orientation of an excavator bucket with respect to the dipper stick of the excavator.

Control systems have been developed for monitoring and automatically controlling the operation of various types of construction equipment, such as for example excavators. Such systems of this general type are disclosed in U.S. Pat. No. 5,461,803, issued Oct. 31, 1995, to Rocke; U.S. Pat. No. 5,062,264, issued Nov. 5, 1991, to Frenette et al; and U.S. Pat. No. 4,964,779, issued Oct. 23, 1990, to Sagaser. In each of these patents, a positioning and control system is disclosed that includes an arrangement for measuring the relative positions of various machine elements, comparing the measured positions with the desired positions in a feedback control system, and adjusting the machine element positions accordingly. In the Rocke patent, displacement sensors sense the amount of piston rod extension in the boom, dipper stick, and bucket hydraulic actuators. To accomplish this, a radio frequency sensor is provided inside each of the hydraulic cylinders. The sensor includes a pair of loop antennas that transmit and receive radio frequency electromagnetic signals, exciting a transverse electromagnetic field in the cavity when the frequency of the signal corresponds to the resonant frequency of the cavity. The resonant frequency of the cavity is primarily dependent upon the longitudinal length of the cavity. Therefore, a voltage controlled oscillator acts under the control of a sawtooth voltage waveform a function generator to deliver a variable frequency signal to the first loop antenna. An RF detector monitors the second loop antenna for an indication that the resonant frequency has been reached. At resonance, a microprocessor samples the output of the voltage-controlled oscillator and correlates the resonant frequency to the length of the coaxial cavity.

The Frenette patent suggests that angle encoders at the pivot points between machine elements may be used to measure the relative positions of these machine elements. Alternatively, the Frenette patent suggests that a sensor measuring the displacement of an actuator, or a camera recording the location of the machine elements may be used. Finally, the Sagaser patent discloses the use of a special hydraulic actuator that includes a specially constructed potentiometer arrangement inside the actuator that varies in electrical resistance in relation to the extension of the piston rod.

These arrangements are expensive, require special parts, and may require frequent service adjustments. Further, the length of time required for servicing such arrangements may be longer than is desirable, due to the need to disassemble the actuators or other components. Accordingly, it is seen that there is a need for a simple, rugged, reliable, and economical arrangement for determining the relative angular orientation between a first machine element and a second machine element.

SUMMARY OF THE INVENTION

These needs are met by an arrangement according to the present invention for determining the relative angular orientation between a first machine element and a second machine element. For example, the present invention may be used to determine the angular orientation of an excavator bucket with respect to the dipper stick of an excavator. The excavator bucket is mounted on a bucket linkage that is pivotally secured to the end of the dipper stick. The machine further includes a linear actuator having a first actuator element pivotally connected to the first machine element and a second actuator element pivotally connected to the second machine element. The first and second actuator elements are linearly moveable with respect to each other, whereby relative linear movement of the actuator elements causes relative pivotal movement between the first and second machine elements. The linear actuator preferably an hydraulic actuator, with the first actuator element comprising an hydraulic cylinder pivotally connected to the dipper stick, and the second actuator element comprising a piston rod pivotally connected to the bucket linkage. Extension or contraction of the hydraulic actuator causes the excavator bucket to be pivoted by the bucket linkage with respect to the dipper stick. This arrangement includes a cable extension linear position transducer having a transducer casing, a sheath extending from the casing, and an extensible cable extending from the sheath. The transducer provides an electrical output related to the extension of the cable from the sheath. A transducer mounting secures the casing of the cable extension linear position transducer in fixed relationship to the hydraulic cylinder. A clip secures the extensible cable to the piston rod. By this arrangement, extension or contraction of the hydraulic actuator causes the output of the transducer to vary, thus providing an electrical output indicating the relative angular orientation of the excavator bucket with respect to the dipper stick.

The clip includes a band around the piston rod, strapping the cable to the piston rod adjacent to the bucket linkage. A mounting is provided for securing the sheath to the hydraulic cylinder near the end of the cylinder from which the piston rod emerges. The sheath includes a rigid end portion from which the cable extends. The rigid end portion includes an outer rigid tube, an inner rigid tube within the outer rigid tube, and a flexible liner within the inner rigid tube. The rigid end portion is oriented such that the cable emerges from the rigid end portion in close proximity to the piston rod and extends in close proximity to the piston rod. The cable extension linear position transducer is mounted such that the sheath and extensible cable extend along the cylinder and the piston rod on the sides thereof generally facing the dipper stick. By this arrangement, the sheath and extensible cable are partially protected by the cylinder and piston rod. The cable extension linear position transducer may be mounted such that the sheath and extensible cable both extend along the cylinder and the piston rod on the side thereof generally, but not directly facing the dipper stick. Alternatively, the sheath and extensible cable may extend along the cylinder and the piston rod on the side thereof directly facing the dipper stick. By these arrangements, the sheath and extensible cable are protected by the cylinder and piston rod. The extensible cable includes a first cable portion extending from the transducer casing, and a second cable portion extending from the sheath. The first and second cable portions are attached together within the sheath.

In an alternative arrangement, the second cable portion extending from the sheath comprises a flexible belt. This flexible belt attaches to the first cable portion within the sheath. Additionally, in this embodiment the mounting provided for securing the sheath to the hydraulic cylinder near the end of the cylinder from which the piston rod emerges also supports a pulley system for guiding and positioning the flexible cable parallel to the piston rod. Further, the sheath is a flexible tube that is sized to allow the belt to move without obstruction therewithin.

In another alternative arrangement, an end of the extensible cable that extends from the sheath is releasably secured by a release mechanism. This release mechanism is secured to the piston rod by the band. Should the extensible cable get snag on an obstruction, the release mechanism will release the secured end of the extensible cable if a certain amount of pull resistance in the reverse direction is overcome by a force. Should it also become necessary to remove the end of the extensible cable from the release mechanism, the release mechanism will release the secured end if a certain amount of pull resistance in the forward direction is overcome by a force. Additionally, the release mechanism prevents the hard bending of the extensible cable at its end by allowing the releasably secured end to rotate through the range of movement of the dipper stick.

Accordingly, it is an object of the present invention to provide an improved arrangement for monitoring the relative angular orientation between a pair of pivotally linked machine parts; to provide a sturdy, simplified mechanism for such monitoring; and to provide an accurate arrangement for accomplishing such monitoring.

It is a further object of the invention to provide an improved arrangement for monitoring the relative angular orientation between a pair of pivotally linked machine parts with a simplified mechanism that functions properly in all encountered work conditions.

Other objects and advantages of the invention will be apparent from the following detailed description, the accompanying drawings, and the appended claims.

DETAILED DESCRIPTION OF THE PREFERRED EMBODIMENT

Figure 1:
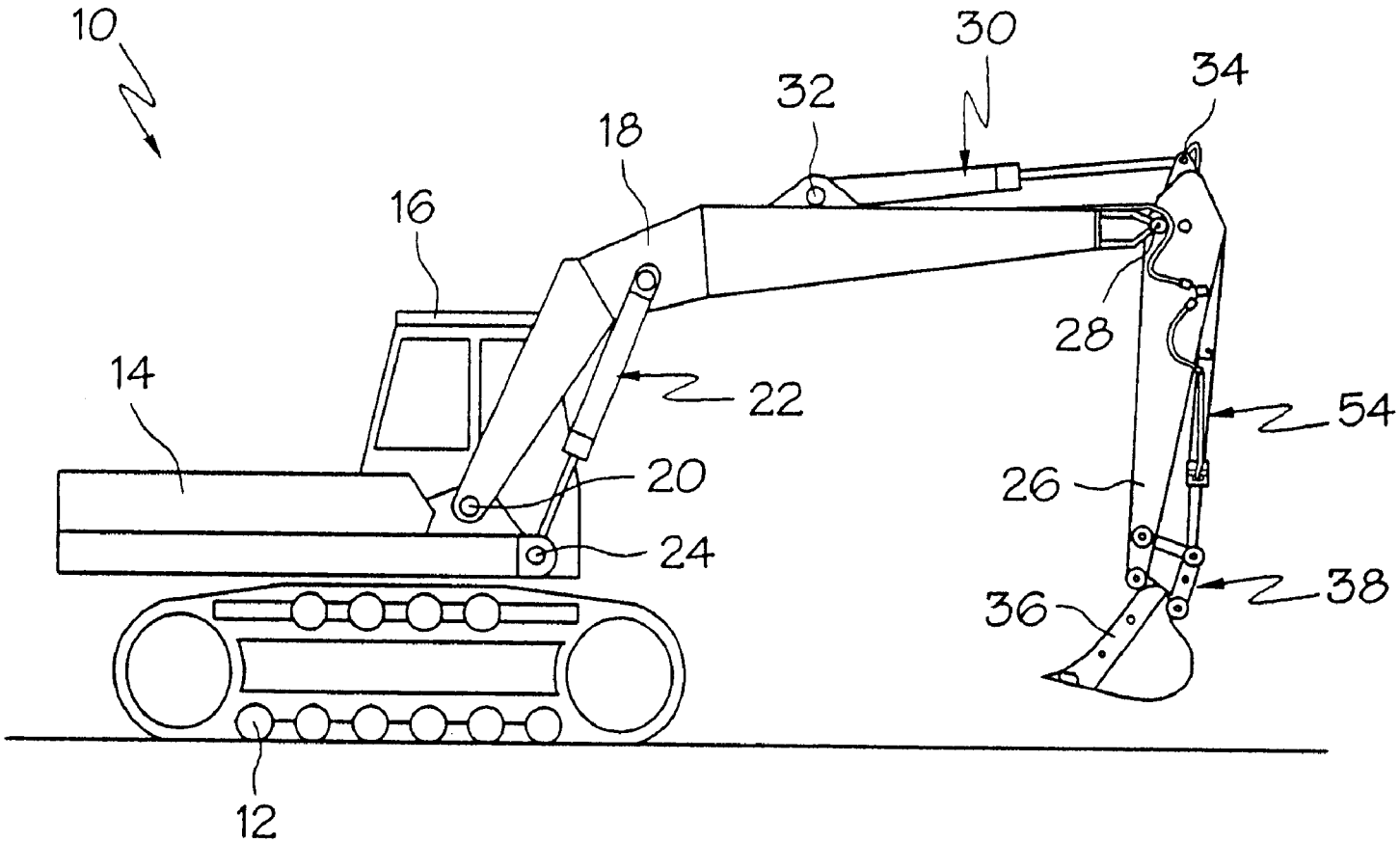
FIG. 1 is a drawing diagrammatically representing a typical excavator of the type with which the present invention may be used.
Figure 2:
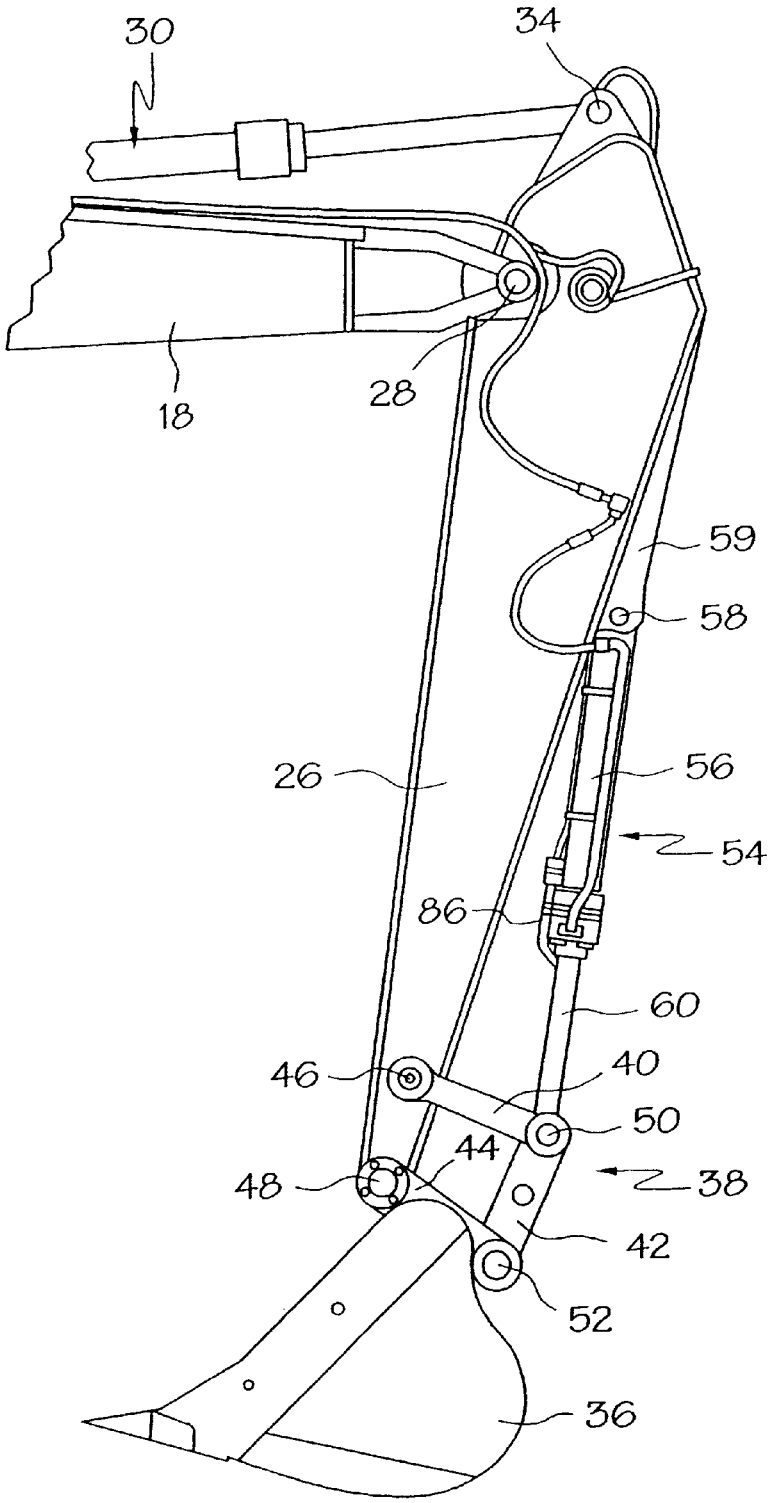
FIG. 2 is an enlarged view of the dipper stick, bucket and bucket linkage of the excavator, with a portion of the boom broken away.
Figure 3:
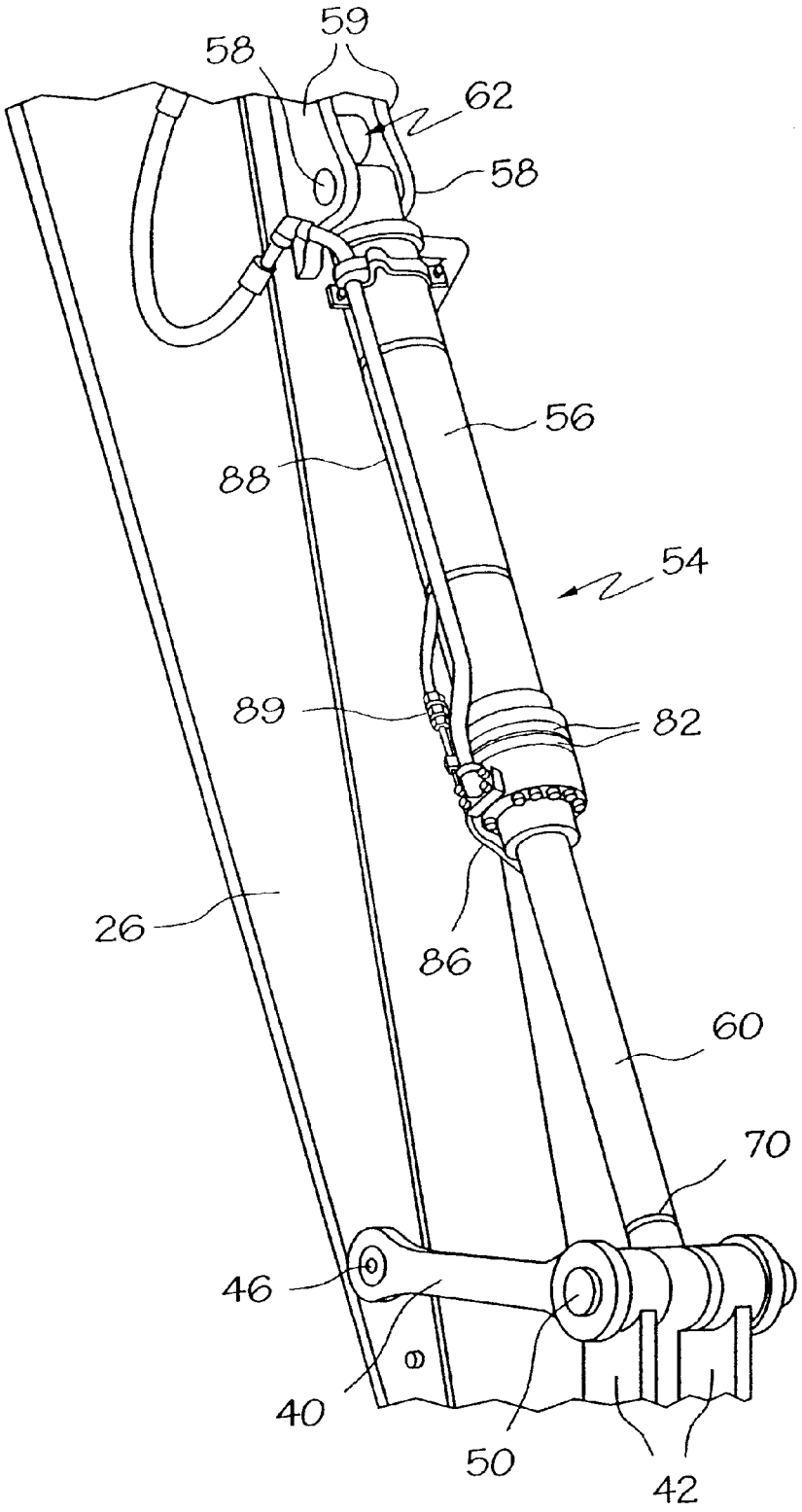
FIG. 3 is a further enlargement of the central portion of the dipper stick, with the upper and lower portions of the dipper stick broken away.

Reference is now made to FIGS. 1–3, which illustrate a typical excavator 10 of the type with which the present invention may be used. Excavator 10 includes ground engaging tracks 12, and a body 14 which has an operator cab 16. A boom 18 is pivotally attached to body 14 at 20. Boom 18 is also pivotally attached to hydraulic actuator 22, which is secured to body 14 at 24 in such a manner that extending actuator 22 causes boom 18 to be raised, and retracting actuator 22 causes boom 18 to be lowered. In similar fashion, dipper stick 26 is pivotally attached to the end of boom 18 at 28. Hydraulic actuator 30 is pivotally attached to boom 18 at 32, and to dipper stick 26 at 34, such that extending actuator 30 causes dipper stick to be rotated in a clockwise direction as seen in FIG. 1, and retracting actuator 30 causes dipper stick to be rotated in a counterclockwise direction as seen in FIG. 1.

In turn, excavator bucket 36 is mounted on a bucket linkage 38 that is pivotally secured to the end of the dipper stick. Bucket linkage 38 includes a pair of parallel links 40 (only one of which is visible in FIGS. 1–3), a pair of parallel links 42 (both of which are visible in FIG. 3) and a pair of parallel links 44 (only one of which is visible in FIGS. 1–3) to which bucket 36 is attached. Links 40 and 44 are pivotally attached to dipper stick 26 at 46 and 48, respectively, and to links 42 at 50 and 52, respectively.

The excavator 10 further includes an hydraulic actuator 54 having an hydraulic cylinder 56 pivotally connected to the dipper stick 26 at 58 between a pair of ridges 59. The hydraulic actuator 54 has a piston rod 60 that is pivotally connected to the bucket linkage 38 at 50. Extension or contraction of the hydraulic actuator 54 causes the excavator bucket 36 to be pivoted by the bucket linkage 38 with respect to the dipper stick 26.

The present invention provides an arrangement for determining the relative angular orientation between a first machine element, the dipper stick 26, and a second machine element, the excavator bucket 36, including the bucket linkage 38, where movement is effect by means of an extensible hydraulic actuator 54 which includes cylinder 56 and piston rod 60. It will be appreciated, however, that this invention has application to constructions in which any sort of linear actuator has linearly moveable elements which cause pivotal movement between machine elements.

In order to monitor the relative position of the bucket 36 and the dipper stick 26, the extension of hydraulic actuator 54 is determined. Once the extension of the actuator 54 is measured, it is a straightforward calculation, based on the geometry of the dipper stick 26, bucket 36, actuator 54, and linkage 38, to determine the relative positions of the bucket 36 and dipper stick 26.

Figure 4:
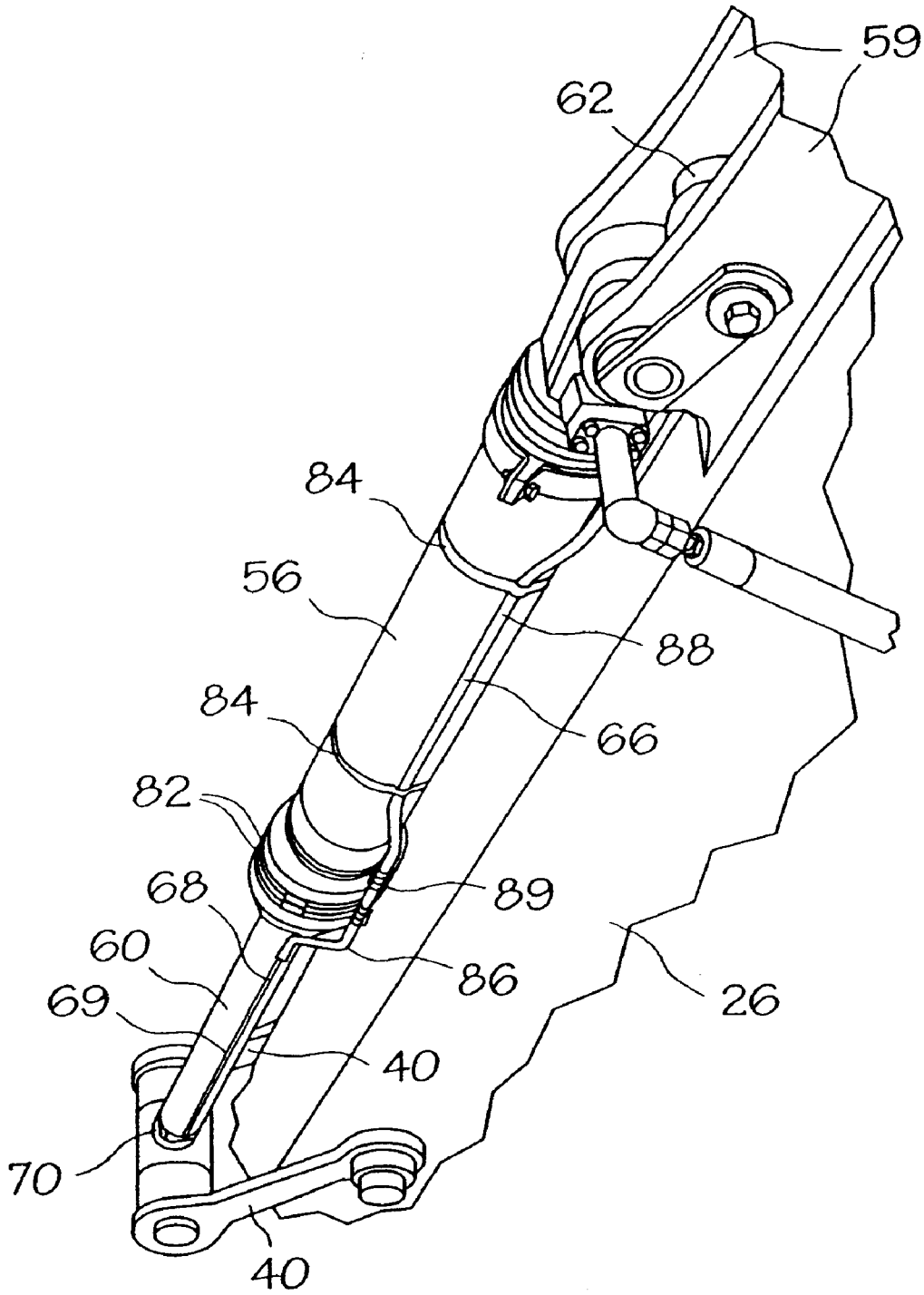
FIG. 4 is a further enlargement of the central portion of the dipper stick, with the upper and lower portions of the dipper stick broken away, as seen from the side of the dipper stick opposite that shown in FIG. 3, illustrating the mounting arrangement for the transducer sheath and a clip that secures the extensible cable to the piston rod.
Figure 5:
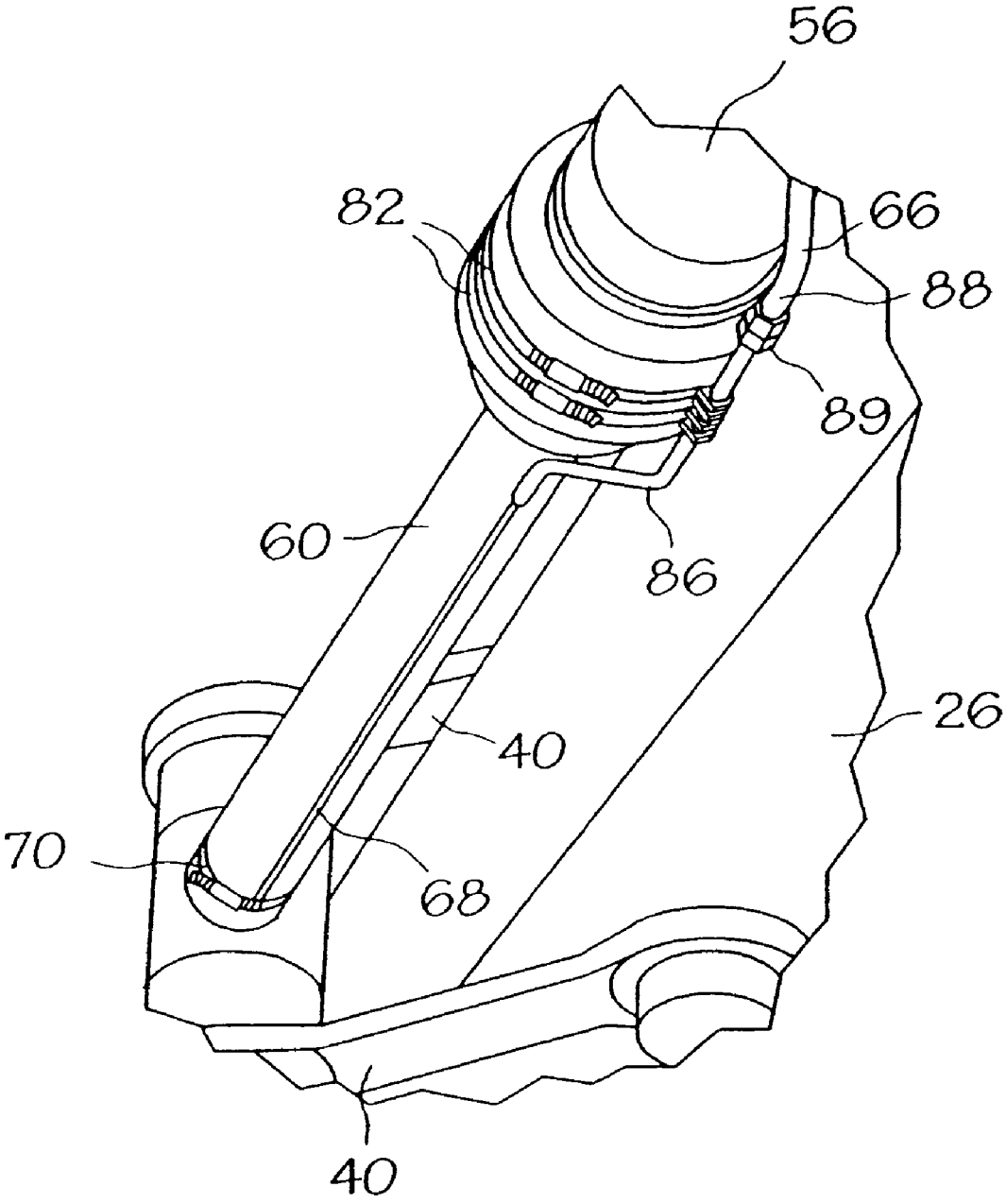
FIG. 5 is a further enlargement of the lower portion of the dipper stick, with the upper and lower portions of the dipper stick broken away, as seen from the same side of the dipper stick shown in FIG. 4, and illustrating the transducer mounting arrangement and the clip in greater detail.
Figure 6:
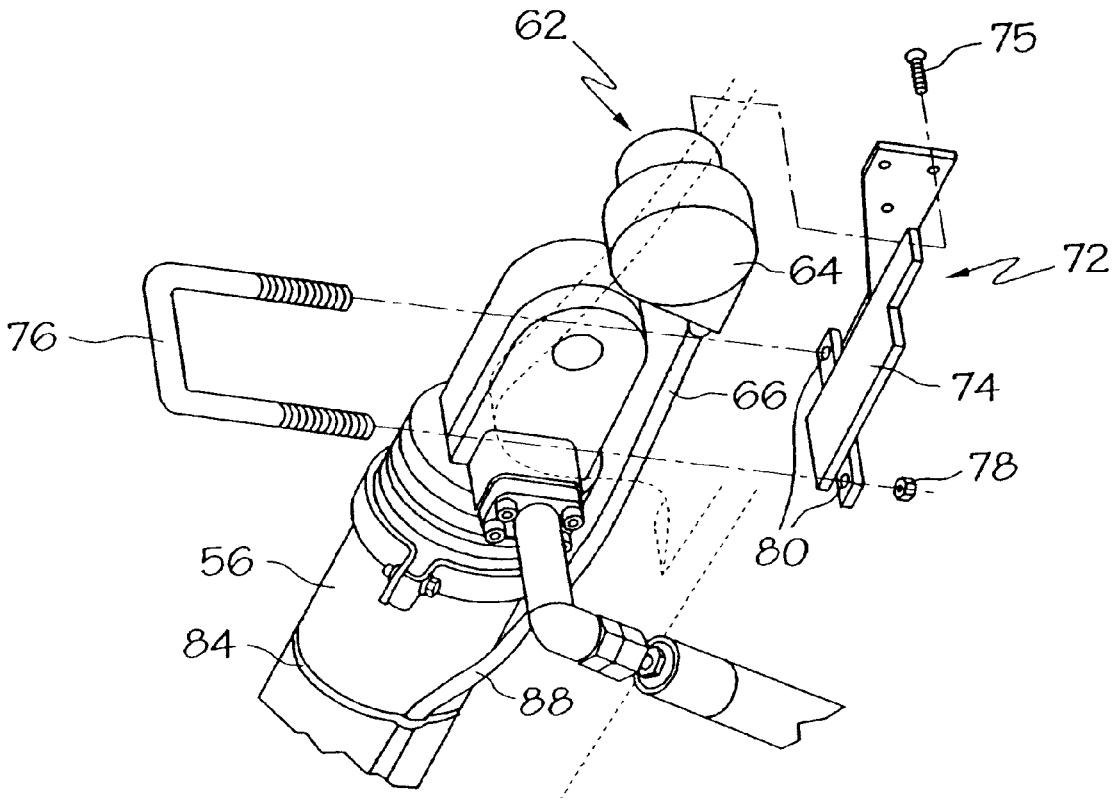
FIG. 6 is an exploded enlargement of the upper end of the hydraulic actuator associated with the dipper stick and bucket linkage, illustrating the cable extension linear position transducer and the transducer mounting that secures the casing of the transducer to the hydraulic cylinder.

As best seen in FIGS. 4–6, but with continuing reference to FIGS. 1–3, the arrangement of the present invention includes a cable extension linear position transducer 62 having a transducer casing 64, a sheath 66 extending from the casing 64, and an extensible cable 68 that extends from the sheath 66. Transducer 62 may be generally of the type available from UniMeasure, Inc., 501 SW Second Street, Corvallis, Oreg. 97333, or from Space Age Control, Inc., 38850 20$^{th}$ Street East, Palmdale, Calif. 93550, although a transducer construction is illustrated and described below with respect to FIGS. 7–9. Such a cable extension linear position transducer does not require critical alignment, is compact in size, rugged, dependable, and is easily installed and serviced. This type of transducer, also known as a string pot, a yo-yo pot, a cable displacement transducer, and a draw wire transducer, provides an electrical output in dependance upon the extent to which the extensible cable is unreeled from the transducer. The cable is attached to a moving object and, as movement occurs, the cable extracts and retracts. A spring within the transducer maintains tension in the cable. The movement of the cable rotates a precision potentiometer, encoder, servo, or synchro within the transducer that produces an electrical output indicative of the cable travel. This, then, effectively translates into an indication of the extension of hydraulic actuator 54.

The extensible cable 68 has a second cable portion 69 which extends from sheath 66. Cable portion 69 is secured to the piston rod 60 by means of a clip 70 which, as best seen in FIG. 5, may take the form of a band 70. The cable 68 also has a first cable portion 71 (FIG. 8) which extends from the transducer casing 64. The first and second portions 71 and 69, are attached together within sheath 66. Band 70 encircles the piston rod 60, and straps the cable portion 69 to the piston rod 60 at the end of the piston rod 60 which is adjacent the bucket linkage 38. As used herein, "clip" is intended to mean any arrangement for securing the end of the cable 68 to the piston rod 60, including bands, clamps, and modifications to the piston rod 60, as well as connectors of various types, such as screws, bolts, and pins.

As best seen in FIG. 6, a transducer mounting 72 secures the casing 64 of the cable extension linear position transducer 62 to the hydraulic cylinder 56 in fixed relationship. The mounting 72 includes mounting plate 74 which is attached to the casing 64 by means of three threaded bolts 75 (only one of which is shown). Mounting plate 74 is secured to the cylinder 56 by means of U-bolt 76 and nuts 78 (only one of which is shown). U-bolt 76 extends over the cylinder 56 and through openings 80 in mounting plate 74, where the threaded ends of U-bolt 76 are engaged by nuts 78, clamping the mounting 72 to the cylinder 56. If desired, plate 74 may be curved or slightly V-shaped to conform to the exterior of cylinder 56. As used herein, "transducer mounting" is intended to mean any type of mechanical arrangement for securing the casing 64 of the cable extension linear position transducer 62 to the hydraulic cylinder 54 in fixed relationship, whether or not directly or indirectly, and includes brackets, bands, clamps, and connectors of various types including screws, bolts, and pins. By this arrangement, extension or contraction of the hydraulic actuator 54 causes the output of the transducer 62 to vary, thus providing an electrical output indicating the extension of the actuator 54 and the relative angular orientation of the excavator bucket 36 with respect to the dipper stick 26. As stated previously, although the output of the transducer 62 does not directly indicate the orientation of the bucket 36, the output of the transducer 62 does however directly correlate with the orientation of the bucket 36.

A mounting for securing the sheath 66 to the hydraulic cylinder 56 near the end of the cylinder 56 from which the piston rod 60 emerges includes a pair of bands 82 which strap the sheath 66 to the cylinder 56. As seen in FIGS. 4 and 6, other bands 84 may also be used to strap the sheath to the cylinder 56. As will be noted, FIGS. 2 and 3 illustrate the sheath 66 and the extensible cable 68 extending along the cylinder 56 and piston rod 60 on the sides thereof which directly face the dipper stick 26. This orientation provides maximum protection from damage which could be caused by the sheath 66 or the cable 68 contacting debris during operation of the excavator. While providing maximum shielding of the sheath 66 and cable 68, in some applications this orientation may increase the risk of damage to sheath 66 or cable 68 from material that may become trapped between the hydraulic actuator 54 and the dipper stick. A compromise in the orientation is shown in FIGS. 4–6, in which the sheath 66 and extensible cable 68 extend along the cylinder 56 and the piston rod 60 on the sides thereof generally, but not directly facing the dipper stick 26. By this arrangement, the sheath 66 and extensible cable 68 are partially protected by the cylinder 56 and piston rod 60, but the cable 68 and sheath 66 will not be damaged should material become lodged between the dipper stick 26 and the hydraulic actuator 54. It will be appreciated additionally that mounting transducer 62 such that it is positioned between ridges 59 also provides protection for the casing 64 of the transducer 62.

Figure 7:
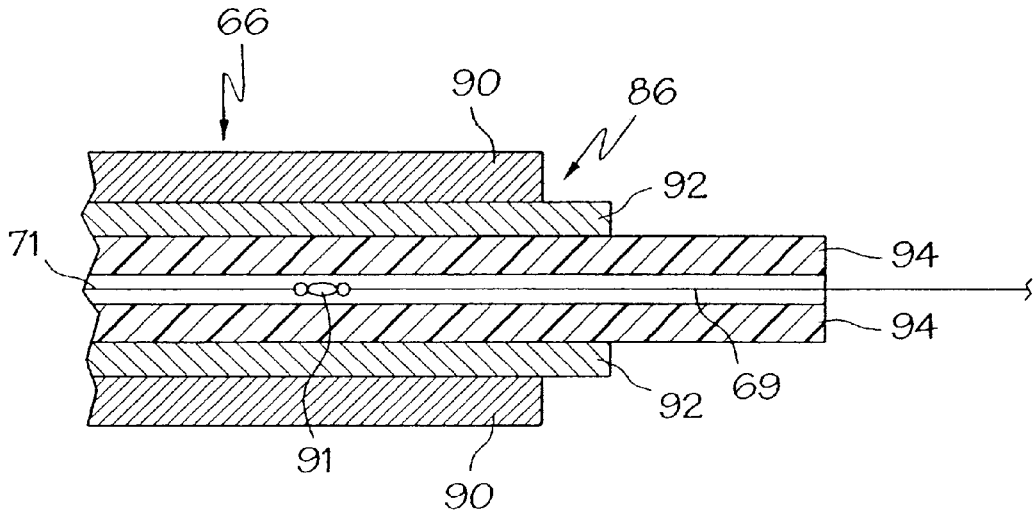
FIG. 7 is an enlarged partial sectional view of the rigid end portion of the transducer sheath.

Reference is now made to FIG. 7, in conjunction with FIGS. 4 and 5, which illustrates the construction of sheath 66 in greater detail. The sheath 66 includes a rigid end portion 86 from which cable portion 69 extends, and a flexible sheath portion 88. Rigid end portion 86 and flexible sheath portion 88 are joined together by fitting 89. The rigid end portion 86 provides a means of positioning the cable 68 such that the cable emerges from sheath 66 in close proximity to the piston rod 60 and extends to clip 70 in close proximity to piston rod 60. Maintaining cable 68 close to piston rod 60 tends to shield cable 68 and makes damage to cable 68 less likely. As seen in FIG. 7, the rigid end portion 86 includes an outer rigid tube 90, an inner rigid tube 92, within the outer rigid tube 90, and a flexible liner 94 within the inner rigid tube 92. Tubes 90 and 92 are preferably metal, such as for example stainless steel. Liner 94 is preferably a polypropylene woven jacket which facilitates the smooth movement of cable portion 69 through end portion 86. Utilizing two tubes 90 and 92 makes crimping and restriction of movement of cable portion 69 less likely, when the rigid end portion is bent into the shape illustrated in the drawings.

Figure 8:
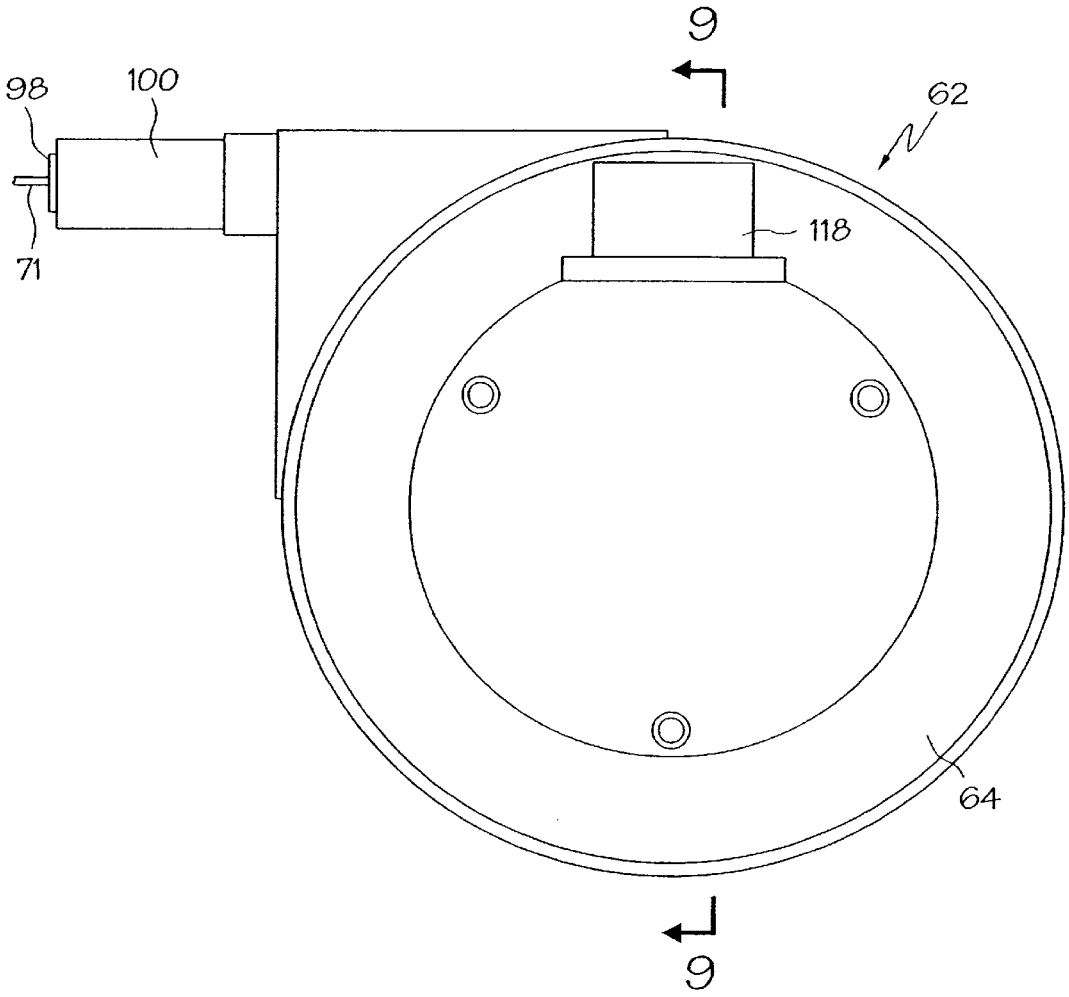
FIG. 8 is a side view of the transducer.
Figure 9:
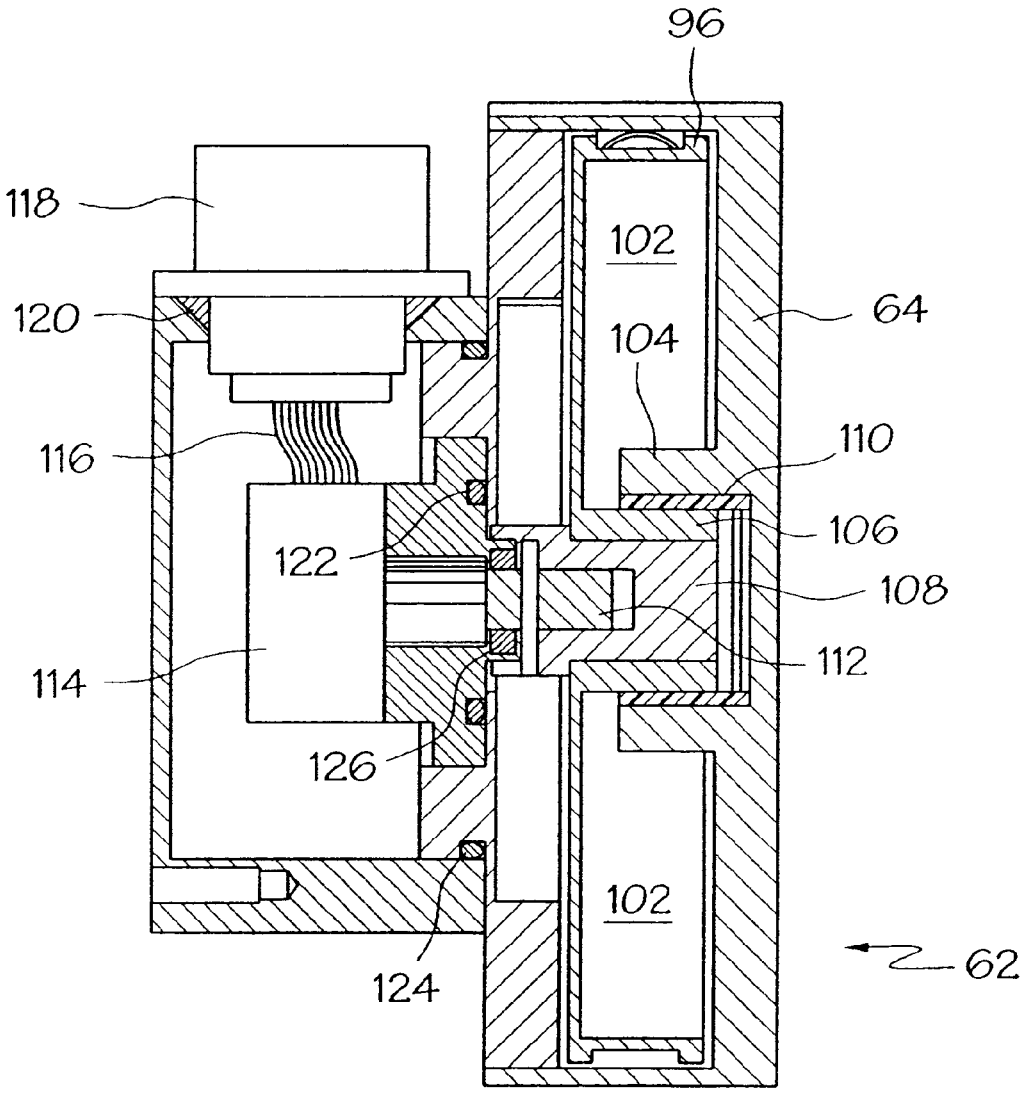
FIG. 9 is a sectional view of the transducer, taken generally along line 9—9 of FIG. 8.

Reference is now made to FIGS. 8 and 9 which illustrate the construction of the cable extension linear position transducer 62. As stated previously, the extensible cable 68 has a second cable portion 69 that is secured to the piston rod 60 and a first cable portion 71 which extends from the transducer casing. Cable portion 71 extends from the transducer casing 64 and is attached to second cable portion 69 within the sheath 66. These cable portions are attached together by means of clips (not shown) which travel within the flexible sheath portion 88. Should the second cable portion 69 (the portion of the cable 68 which is exposed outside of sheath 66) be torn or cut, the cable 71 will be rapidly rewound onto cable reel 96. A spring loaded bumper 98, surrounding the opening from which first cable portion 71 extends, will cushion the impact of the clips that join the cable portions together striking a fitting 100 which extends from casing 64. This prevents the clips from being broken from the end of cable portion 71, and facilitates replacement of cable portion 69.

For purposes of clarity, the cable portion 71 has been removed from the sectional view of FIG. 9, as has the helical spring which spirals within annular space 102 defined by cable reel 96. The helical spring is attached to reel 96 and to the portion 104 of casing 64, such that as the cable portion is withdrawn from the transducer and unwound from the reel 96, the helical spring becomes increasingly coiled and the cable 68 is maintained under tension as piston rod 60 moves in either direction.

The reel 96 has a hub portion 106 which is pressed on connector 108. Reel 96 rotates within self-lubricating bushing 110. Connector 108 is, in turn, pinned to shaft 112 of optical quadrature encoder 114. Encoder 114 provides an electrical output via conductors 116 to electrical connector 118. The electrical output from connection 118 may be accumulated, providing an indication of the then current extension or contraction of the hydraulic actuator 54. This, in turn, is directly related to the relative angular orientation between the excavator bucket 36 and the dipper stick 26.

As will be appreciated, the arrangement of the present invention is operated under adverse environmental conditions. Accordingly, it is desirable to seal the casing 64, and especially the portion of the casing 64 in which encoder 114 is mounted. For this purpose, seals 120, 122, 124, and 126 are provided.

The flexible sheath portion 88 is attached to the transducer casing 64 at fitting 100. It will be further appreciated that sheath portion 88 may be subjected to ambient temperature fluctuations when the arrangement of the present invention is operated at a job site. This temperature change may undesirably lengthen or shorten sheath portion 88 which could result in an error in the electrical output from transducer 62. In order to prevent this, it may be desired to couple sheath portion 88 to fitting 100 by an arrangement that permits the sheath portion to slip over the fitting, compensating for changes in the length of the sheath portion 88 which result from temperature changes.

Figure 10:
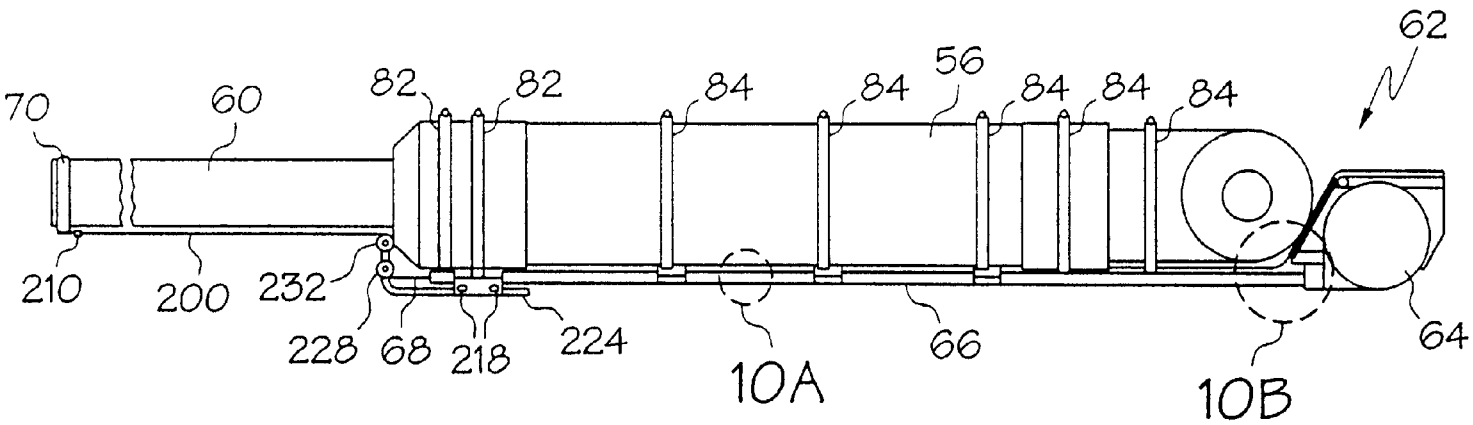
FIG. 10 is an enlargement of the hydraulic actuator associated with the dipper stick and bucket linage, and illustrates the cable extension linear position transducer and mounting arrangement in an alternative embodiment of the present invention.
Figure 10B:
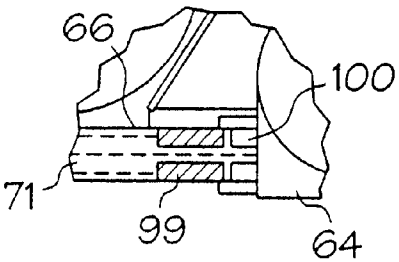
Figure 10A:
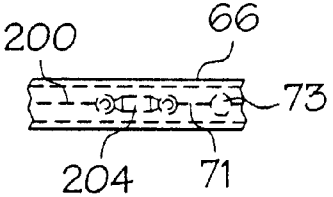
Figure 11:
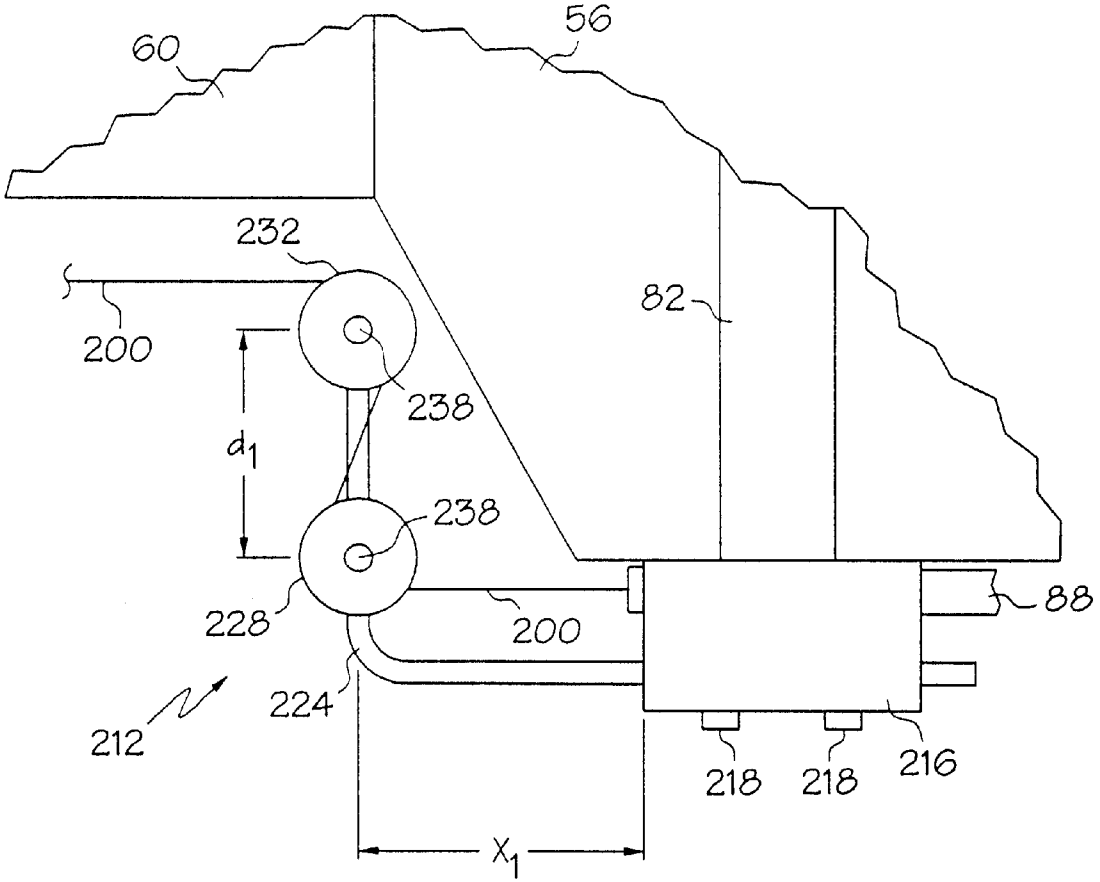
FIG. 11 is an enlargement of the pulley system of FIG. 10.

FIGS. 10 and 11 illustrate an alternative embodiment of the present invention. As will become apparent, the mechanical components of this embodiment are designed to be particularly rugged and useful for operation in adverse environmental conditions. The illustrated mechanical arrangement ensures that the extensible cable 68 remains moveable within the sheath 66 in a wet environment. In the previous configuration the second cable portion 69 connecting to the piston rod 60 by clip 70 is mostly unprotected from environmental elements as it extends from the rigid end portion 86 (FIG. 4). In a wet environment, dirt falling from the bucket may collect on the exposed cable. This dirt, with each movement of the piston rod, may be drawn into the rigid end portion 86 and sheath 66. Accordingly, accumulation of dirt may clog-up the rigid end portion 86 and sheath 66. With the rigid end portion 86 or sheath 66 blocked, thereby obstructing movement of the extensible cable 68, the transducer 62 will fail to give accurate position information. Additionally, due to the dirt and debris coating and gathering in the sheath 66, clearing such a blockage may require disassembling the cable 68 from the sheath 66.

To avoid the above mentioned problems in this embodiment, as illustrated in FIG. 10, the second cable portion 69 is replaced with a flexible belt 200. This flexible belt can made of any suitable material that functions well in the various environmental elements encountered. One such material is neoprene. As mentioned above, the flexible belt 200 is attached to the first cable portion 71 within the sheath 66 at a first end attachment 204, forming together an extensible belt cable 206. This first end attachment 204 is preferably a swivel joint coupled to the first cable portion 71 to prevent the flexible belt from being twisted by movement of first cable portion. The flexible belt 200 at an opposed end to the first end attachment 204, is conventionally coupled to the clip 70 by a second end attachment 210. The second end attachment 210 is preferably an eyelite attachment (not shown) crimped to an end of the flexible belt and bolted to the clip 70.

It is desirable to provide for slowing the movement of the cable portion in the event that it is fully retracted into the transducer 62. To accomplish this a ball 73 is attached to the first cable portion 71, and a braking tube 99, preferably made of silicon, is inserted within the sheath 66 adjacent the fitting 100, which attaches the sheath 66 to the casing 64. It is to be appreciated that the outer diameter of the ball 73 is smaller than the inner diameter of the sheath 66 to permit free movement of cable portion 71. However, should the flexible belt 200 break, the braking tube 99, having an inner tube diameter slightly less than the outer diameter of the ball 73, will slow movement of the first cable portion 71 as it is retracted into the transducers 62, thereby reducing any impact on the components of the transducer 62. If desired, the first end attachment 204 could have a diameter sized slightly larger then the inner tube diameter of the braking tube 99, thereby eliminating the need for the ball 73. However, it is to be appreciated that the ball 73 is attached to the first cable portion 71 a distance from the first end attachment 204 so that when the ball is stopped within the braking tube 99, the first end attachment will not be embedded within the braking tube. This will provide for easier extensible belt cable access and replacement.

In this alternative arrangement, the rigid end portion 86 and fitting 89 (FIG. 5) are replaced with a belt pulley system 212, as shown in FIG. 11. The belt pulley system 212 consists of a support bracket 216 that is coupled to the hydraulic cylinder 56 by bands 82. Support bracket 216 secures sheath 66 adjacent to hydraulic cylinder 56. The pulley system 212 further has a pair of belt pulleys 228 and 232 coupled to an extension bar 224 which is firmly attached to the support bracket 216 by a pair of clamping screws 218. It is to be appreciated that the extension bar can be repositioned in the bracket 216 by loosening clamping screws 218, allowing the extension bar to slide freely in the bracket.

The extension bar 224 is sized and shaped to ensure that the flexible belt 200, when engaged in the belt pulleys 228 and 232, is positioned in close proximity to the piston rod 60 and extends to clip 70 in close proximity to piston rod 60. Preferably, the belt pulleys 228 and 232 are set such that the portion of the belt extending between them is at approximately a right angle to the piston rod 60. The first belt pulley 228 is positioned on the extension bar 224 a distance $d_l$ directly from second belt pulley 232. The mounting arrangements for the belt pulleys 228 and 232 are such that the positions of the pulleys 228 and 232 may adjusted. It is to be appreciated that distance $d_l$ can be adjusted to maintain proper tension between the flexible belt and belt pulleys, as the pulleys 228 and 232 are preferably fixed to the extension bar individually by a set screw (not shown). Due to environmental concerns, it is preferable that an ultra high molecular weight polyethylene be used for the belt pulleys in combination with tungsten carbide pins for the pulleys' mounting posts 238.

The extension bar 224 has a length $x_l$ such that the second belt pulley 232 is located at a close proximity to the piston rod 60 and the end of the hydraulic cylinder 56 from which the piston rod 60 emerges. It is to be appreciated the both distance $d_l$, and length $x_l$ can further vary depending on the dimension of the hydraulic cylinder 56 and the mounting position of the pulley system to the hydraulic cylinder by bands 82. Additionally, it is to be appreciated that belt pulleys 228 and 232 are over-sized relative to the flexible belt 200 to provided for a very loose fit so that dirt and debris will not interfere with movement of the belt thereon. In this arrangement, each belt pulley has a outside diameter ranging from 0.5 to 0.75 inch, preferably 0.625 inch, an inside diameter ranging from 0.25–0.5 inch, preferably 0.4 inch, and a width of 0.2–0.5 inch, preferably 0.375 inch, to accommodate a flexible belt having a width of 0.125–0.2 inch, preferably 0.1875 inch. Further, it is to be appreciated that the sheath 66 in this embodiment includes only the flexible sheath portion 88 which is sized to allow the flexible belt 200 to move freely within. In this manner, attached dirt and debris will not interfere with the movement of flexible belt 200 within the flexible sheath portion 200. Moreover, elimination of the rigid end portion 86 and fitting 89 in this embodiment facilitates easier belt replacement when necessary.

Figure 12:
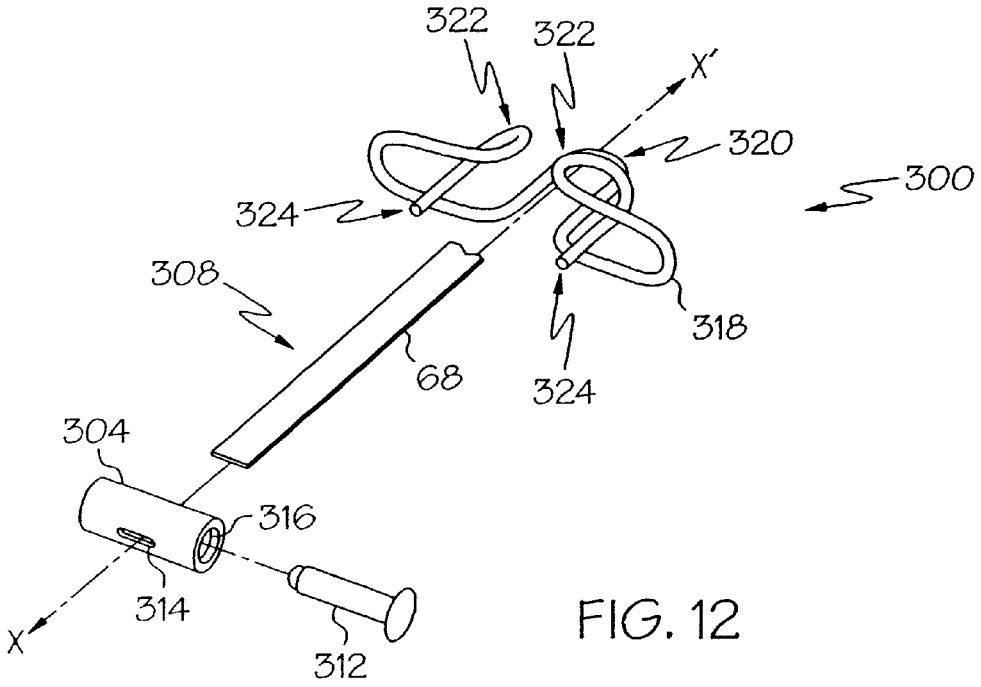
FIG. 12 is an exploded view of a release mechanism associated with an end of the extensible cable in an alternative embodiment of the present invention.
Figure 13:
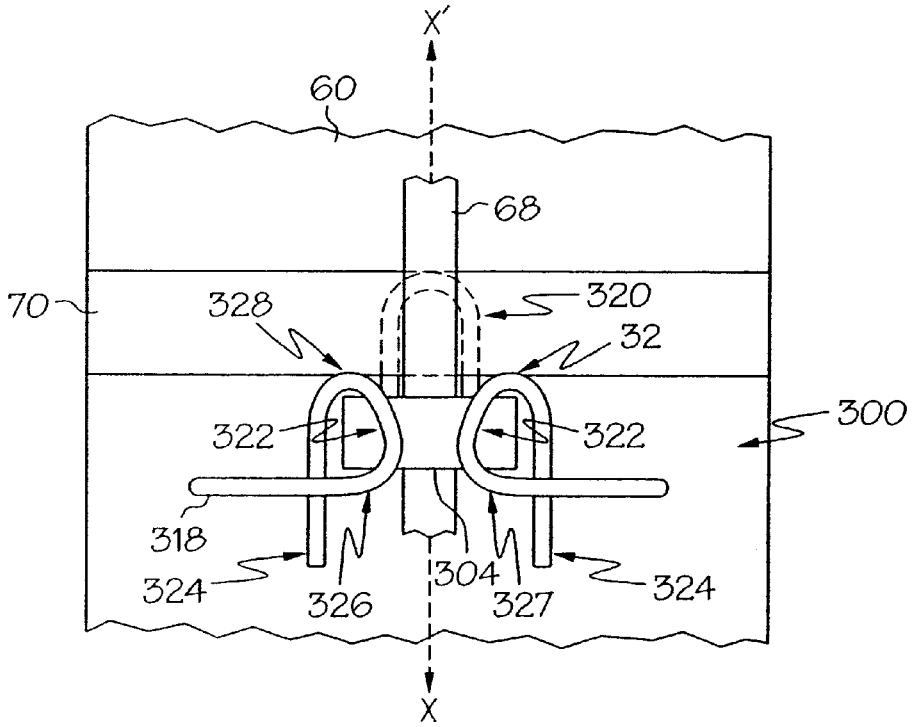
FIG. 13 is a top view of the release mechanism of FIG. 12, and illustrates the extensible cable being releasably secured to the piston rod by the release mechanism in an alternative embodiment of the present invention.

FIGS. 12 and 13 illustrate another alternative embodiment of the present invention. With the same purposes as mentioned above, the mechanical components of this embodiment are also designed to be particularly rugged and useful for operation in the encountered environmental conditions. The illustrated mechanical arrangement reduces the wear and tear on the portion of the extensible cable 68 that extends from the sheath 66 (FIG. 5) during operations. In the previous configuration the second cable portion 69 is connected to the piston rod 60 by clamp band 70 (FIG. 5). During operation of the bucket should the exposed extensible cable become snagged on an obstruction, such as a root, the extensible cable may break or worse, damage the transducer from over extension. Additionally, because the extensible cable is fastened to the piston rod by clamp band 70, due to continuous bend as the piston rod moves over its full range of movement the extensible cable may wear at this attachment point over time.

To avoid the above mentioned problems in this embodiment, as illustrated in FIG. 12, a release mechanism, generally indicated by 300, is used. The release mechanism 300 consist of two components, the first component being a stopper 304. The stopper 304 has hollow cylindrical shape, and is preferably made from brass tubing. The stopper 304 is fastened to an end portion 308 of the extensible cable 68 in any conventional manner, but preferably by a rivet 312. As illustrated, the end portion 308 of the extensible cable 68 passes completely through a through bore or slit 314 provided in stopper 304 in a forward direction, indicated by dashed line x. An opening 316 provided in stopper 304 allows the rivet 312 to fasten within the interior space of the stopper 304 by an interference fit, thereby also securing the end portion 308 of the extensible cable 68 by an interference fit to the stopper 304. It is to be appreciated that by securing the end portion 308 of the extensile cable 68 in this manner, facilitates a quick and an easy repair should the extensible cable break with common trade tools typically available at an operation site.

The second component of the release mechanism 300 is a retaining cage 318. The stopper 304 once attached to the end portion 308 of the extensible cable 68 is inserted into the retaining cage 318 in a reverse direction, indicated by dashed line x'. The retaining cage 318 being formed from a single rod of a sturdy but flexible material, such as aluminum, includes such features or portions as a U-shaped tongue 320, a pair of wings 322, and a pair of retaining rails 324. A discussion of these features of the retaining cage 318 is provided hereafter with reference to FIGS. 13, 14*a* and 14*b*.

FIG. 13 shows a top view of the release mechanism 320, and illustrates the extensible cable 68 being releasably secured to the piston rod 60 by the release mechanism 300 in this alternative embodiment of the invention. The retaining cage 318 is secured to the piston rod 60 by its tongue 320 being clamped underneath the clamp band 70. With the retaining cage 318 firmly attached to the piston rod 60, the stopper 304 is retained within a retaining cavity formed by forward wing portions 326 and 327 and rear wing portions 328 and 329 of the pair of wings 322, and by the pair of retaining rails 324.

Figure 14A:
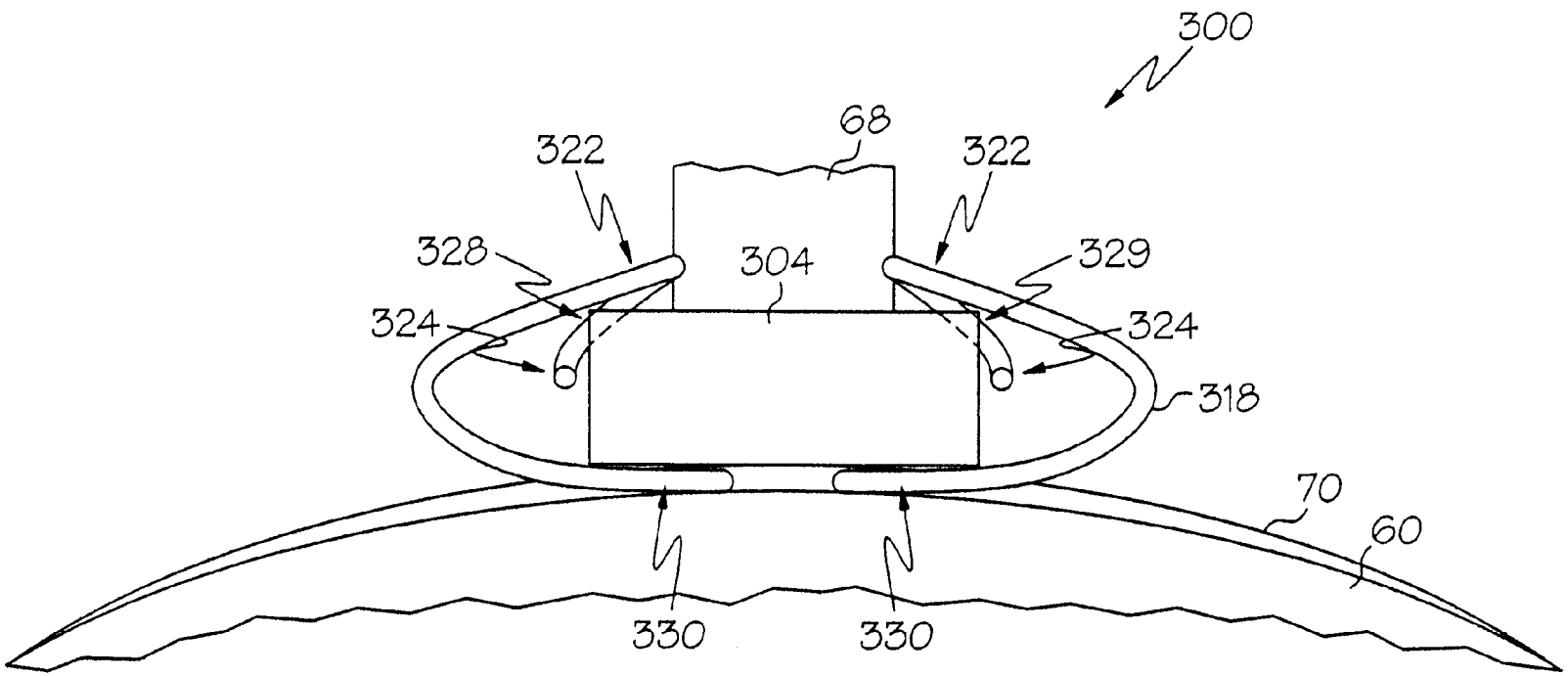
FIGS. 14*a* and 14*b* are a front view of the release mechanism of FIG. 13, and illustrates the extensible cable being rotated perpendicular to the piston rod while releasably securing the stopper of the pressure mechanism by tightening the band around the piston rod in the alternative embodiment of the present invention.
Figure 14B:
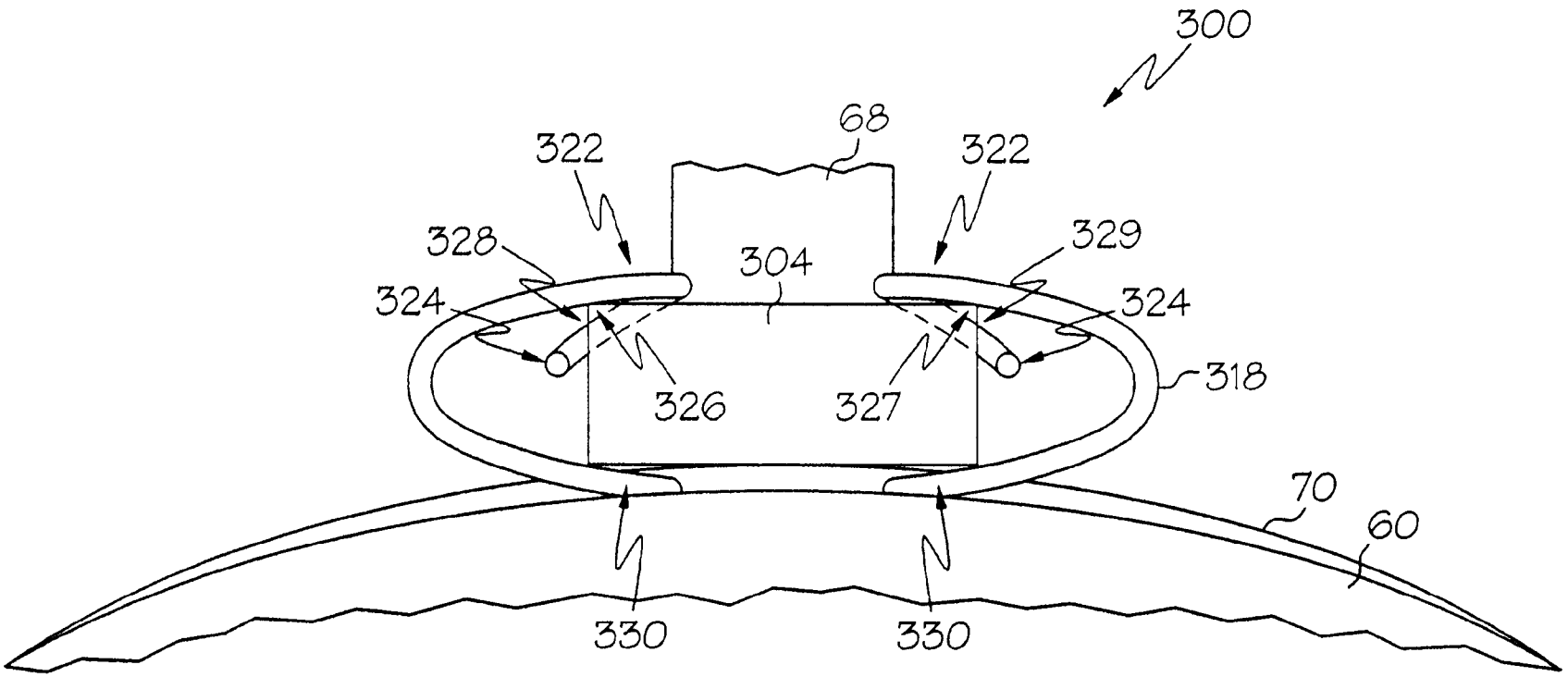

As illustrated by the dashed lines of FIGS. 14*a* and 14*b*, the rear portions 328 and 329 of the retaining cage 318 obstruct the movement of the stopper in the x' direction. Should the extensible cable 68 get snag on an obstruction, the retaining cage 318 will release the stopper 304 in the reverse direction x' once an applied force on the extensible cable in the x' direction overcomes a retaining force or spring bias caused by the rear wing portion 328 and 329. It is to be appreciated that since the tension on the extensible cable 68 from the spring within the transducer is typically about 2 to about 3 pounds, the retaining force of the pair of wings 322 of the retaining cage 318 is about 10 to about 25 pounds. It is also to be appreciated that the pair of wings 322 of the retaining cage 318 compress slightly inward due to the clamping of the tongue 320 by clamp band 70 to the piston rod 60, which is explain more specifically hereafter with reference to FIGS. 14 and 14*b*.

FIGS. 14*a* and 14*b*, showing a front view of the stopper 304 being retained by the retaining cage 318, illustrate the inward movement of the pair of wings 322. The clamp band 70 in FIG. 14*a*, being relatively loose, allows the tongue 320 (FIG. 13) of the retaining cage 318 to slide between the piston 60 and clamp band 70. As explained above, clamping or tightening the clamp band 70 secures the retaining cage 318 of the release mechanism 300 to the piston 60. It is to be appreciated that with a relatively loose clamp band 70, the pair of wings 322 of the retaining cage 318 are filly spread apart due to an uncompressed pair of shoulders portion 330 of the retaining cage 318.

As the clamp band 70 is fully tightened and secured to the piston 60, as illustrated in FIG. 14*b*, the compression or flattening of the pair of shoulders portions 330 causes the forward wing portions 326 and 327 of the pair of wings 322 to drop slightly in front of the stopper 304, enclosing the stopper 304 within the retaining cage 318, preventing the movement of the stopper in the forward direction x. The stopper 304 enclosed in this manner allows the extensible cable 68 to rotate, if necessary, perpendicular to the piston rod 60, thereby reducing the wear and tear on the extensible cable 68 at this securing point from the movement of the piston rod 60. Should it become necessary to remove the extensible cable 68 from the release mechanism 300, an applied force on the end portion 308 (FIG. 12) of the extensible cable 68 in the forward direction x will release the stopper 304 from the retaining cage 318 once a holding force or spring bias of forward wing portions 326 and 327 on the stopper 304 is overcome.

Having described the present invention in detail an d by reference to various embodiments thereof, it will be apparent that certain modifications and variations are possible without departing from the scope of the invention defined in the appended claims.

What is claimed is:

1. An arrangement for determining the relative angular orientation of an excavator bucket with respect to the dipper stick of an excavator, the excavator bucket being mounted on a bucket linkage pivotally secured to the end of the dipper stick, the excavator including an hydraulic actuator having an hydraulic cylinder pivotally connected to said dipper stick and a piston rod pivotally connected to said bucket linkage, whereby extension or contraction of said hydraulic actuator causes said excavator bucket to be pivoted by said bucket linkage with respect to said dipper stick, comprising:

a cable extension linear position transducer having a transducer casing, a sheath extending from said casing, and an extensible cable extending from said sheath, said transducer providing an electrical output related to the extension of said cable from said sheath;

a transducer mounting for securing said casing of said cable extension linear position transducer in fixed relationship to said hydraulic cylinder;

a pulley system positioning said cable extending from said sheath in close proximity to said piston rod; and a release mechanism releasably securing said extensible cable to said piston rod, said release mechanism fastened to said piston rod, whereby extension or contraction of said hydraulic actuator causes the electrical output of said transducer to vary, thus providing an electrical output indicating the relative angular orientation of said excavator bucket with respect to said dipper stick.

2. The arrangement for determining the relative angular orientation of an excavator bucket with respect to the dipper stick of an excavator according to claim 1, in which said release mechanism is fasten to said piston rod by a clamp band around said piston rod.

3. An arrangement for determining the relative angular orientation between a first machine element and a second machine element, said first and second machine elements being pivotally connected, and an hydraulic actuator having an hydraulic cylinder pivotally connected to said first machine element and a piston rod pivotally connected to said second machine element, whereby extension or contraction of said hydraulic actuator causes relative pivotal movement between said first and second machine elements, comprising:

a cable extension linear position transducer having a transducer casing, a sheath extending from said casing, and a first cable portion attached to said transducer at one end, to a flexible belt portion at another end, forming together an extensible belt cable, said flexible belt portion extending from said sheath, said transducer providing an electrical output related to the extension of said belt from said sheath, a transducer mounting for securing said casing of said cable extension linear position transducer in fixed relationship to said hydraulic cylinder, a pulley system for positioning said flexible belt extending from said sheath in close proximity to said piston rod; and a release mechanism releasably securing said extensible cable to said piston rod, said release mechanism fastened to said piston rod, whereby extension or contraction of said hydraulic actuator causes the electrical output of said transducer to vary, thus providing an electrical output indicating the relative angular orientation between said first machine element and said second machine element.

4. The arrangement for determining the relative angular orientation between a first machine element and a second machine element according to claim 3, in which said release mechanism is fasten to said piston rod by a clamp band around said piston rod, retaining said flexible belt portion to said piston rod adjacent said second machine element.

5. In an arrangement for determining the relative angular orientation between a first machine element and a second machine element, said first and second machine elements being pivotally connected, and an hydraulic actuator having an hydraulic cylinder pivotally connected to said first machine element and a piston rod pivotally connected to said second machine element, whereby extension or contraction of said hydraulic actuator causes relative pivotal movement between said first and second machine elements, a release mechanism for retaining an extensible cable adjacent said second machine element comprising:

a retaining cage having portions which form a retaining cavity; and a stopper attachable to an end portion of said extensible cable and rotatably retainable within said retaining cavity, said stopper being releasable in a reverse direction from said retaining cavity if an applied force on said extensible cable exceeds a retaining force of said portions of said retaining cage in said reverse direction.

6. The release mechanism according to claim 5, in which said stopper is further releasable in a forward direction from said retaining cavity if an applied force on said extensible cable exceeds a holding force of said retaining cage in said forward direction.

7. The release mechanism according to claim 5, in which said portions of said retaining cage are forward and rear wing portions of a pair of wings, rail portions, and a tongue.

8. The release mechanism according to claim 7, in which said release mechanism is retained to said piston rod by a clamping band engaging said tongue of said retaining cage.

9. The release mechanism according to claim 8, in which said portions of said retaining cage further include shoulder portions, wherein when said clamping band secures said release mechanism to said piston rod, said shoulders flatten causing said forward wing portions to drop slightly to enclose said stopper in said forward direction within said retaining cavity.

* * * * *

UNITED STATES PATENT AND TRADEMARK OFFICE

CERTIFICATE OF CORRECTION

PATENT NO. : 6,447,240 B1
DATED : September 10, 2002
INVENTOR(S) : Cain et al.

It is certified that error appears in the above-identified patent and that said Letters Patent is hereby corrected as shown below:

Column 1,
Line 46, reads “waveform a function” should read -- waveform from a function --

Column 2,
Line 23, reads “preferably an hydraulic actuator,” should read -- preferably comprises an hydraulic actuator --

Column 4,
Line 11, reads “bucket linage” should read -- bucket linkage --

Column 9,
Line 11, reads “x1” should read -- x1, --

Column 10,
Line 4, reads “extensile cable 68” should read -- extensible cable 68 --
Line 34, reads “get snag on” should read -- get snagged on --
Line 46, reads “which is explain more” should read -- which is explained more --
Line 57, reads “are filly” should read -- are fully --

Column 11,
Line 11, reads “detail an d by” should read -- detail and by --
Line 49, reads “is fasten to said” should read -- is fastened to said --

Column 12,
Line 23, reads “is fasten to said” should read -- is fastened to said --

Signed and Sealed this

Eleventh Day of February, 2003

JAMES E. ROGAN
*Director of the United States Patent and Trademark Office*